US006024547A

United States Patent [19]

Nagae

[11] Patent Number: 6,024,547

[45] Date of Patent: Feb. 15, 2000

[54] POWER-VARIABLE COMPRESSOR AND AIR CONDITIONER USING THE SAME

[75] Inventor: Koji Nagae, Oizumi-machi, Japan

[73] Assignee: Sanyo Electric Co., Ltd., Osaka, Japan

[21] Appl. No.: 09/007,382

[22] Filed: Jan. 15, 1998

[30] Foreign Application Priority Data

Jan. 17, 1997 [JP] Japan ..... 9-006983
Jan. 17, 1997 [JP] Japan ..... 9-006984

[51] Int. Cl.[7] ..... F01C 1/30

[52] U.S. Cl. ..... 418/11; 418/13; 418/15; 418/23; 417/62

[58] Field of Search ..... 418/23, 11, 13, 418/15; 417/62

[56] References Cited

U.S. PATENT DOCUMENTS

| | | | |
|---|---|---|---|
| 2,458,018 | 1/1949 | Murphy . | |
| 4,397,618 | 8/1983 | Stenzel | 418/23 |
| 4,592,705 | 6/1986 | Ueda et al. | 418/63 |
| 5,050,233 | 9/1991 | Kaisha et al. | 417/427 |
| 5,322,424 | 6/1994 | Fujio | 418/11 |
| 5,443,376 | 8/1995 | Choi | 418/63 |

FOREIGN PATENT DOCUMENTS

| | | | |
|---|---|---|---|
| 599716 | 6/1960 | Canada | 417/62 |
| 0222109 | 5/1987 | European Pat. Off. . | |
| 0724078 | 7/1996 | European Pat. Off. . | |
| 59-051187 | 3/1984 | Japan . | |
| 0212797 | 9/1988 | Japan | 417/62 |
| 08247560 | 9/1996 | Japan . | |
| 2209193 | 5/1989 | United Kingdom . | |

*Primary Examiner*—Thomas Denion
*Assistant Examiner*—Thai-Ba Trieu
*Attorney, Agent, or Firm*—Darby & Darby

[57] ABSTRACT

A multi-rotor type compressor including plural compression elements each of which includes a rotor eccentrically rotating in a cylinder and a vane which is in sliding contact with the outer peripheral surface of the rotor and partitions the inside space of the cylinder into a suck-in space in which a suck-in operation is performed and a compression space in which a compressing operation is performed, and a power save mechanism including an intercommunication path through which the compression space of a compression element is allowed to intercommunicate with the suck-in space of another compression element at a predetermined phase, an interception valve for intercepting flow of fluid in the intercommunication path, and a check valve which is provided in the intercommunication path and allows the fluid to flow therethrough in only one direction. The compression may be equipped in an air conditioner. In addition to the power save mechanism may be provided a compression stop mechanism for stopping a prescribed compression operation to reduce a part of the entire compression work of the compressor.

12 Claims, 13 Drawing Sheets

POWER-VARIABLE COMPRESSOR AND AIR CONDITIONER USING THE SAME

BACKGROUND OF THE INVENTION

1. Field of the Invention

The present invention relates to a power (capacity)-variable compressor and an air conditioner having the compressor, and particularly to a technique of performing power(capacity) control at multistage while reducing the power consumption.

2. Description of the Related Art

In most of recent air conditioners, the power control is performed at a heat source side (compressor side) in accordance with a demanded power (capacity) at an user side (indoor heat exchanger) in order to prevent overshoot or hunting of room temperature in cooling operation. A method of converting the frequency of alternating current by using an inverter to linearly control the driving rotational number of the compressor has been generally used to control the power (capacity) of the compressor. According to this method, the power of the compressor is freely variable from 0 to the rating point of the compressor, and thus the air conditioner can be substantially perfectly controlled. However, the inverter itself has various problems that energy loss due to frequency conversion is unavoidable, that it emits undesired electromagnetic wave to the environment and that a large-scale inverter increases the cost of the apparatus.

Therefore, Japanese Laid-open Patent Application No. Hei-8-247560 has proposed a power-variable type constant-speed compressor in which the power control is performed by a power save mechanism and a refrigerant return circuit while using a constant-speed compressor containing a compressor mechanism which is drive at a constant speed. According to the power save mechanism, a valve device is provided to the cylinder side wall or the like of a compression mechanism, and the compressing action is not performed at a first half of a compression process by opening the valve device, for example. Further, according to the refrigerant return circuit, a bypass circuit is provided between a refrigerant circuit at a discharge side of the compressor and a refrigerant circuit at a suck-in side of the compressor, and a part of refrigerant after the compression is circulated into the suck-in side refrigerant circuit.

When a power-variable type constant-speed compressor and a normal constant-speed compressor are combined, the multistage power control can be performed by individually driving or stopping both the compressors or using the power save mechanism and/or the refrigerant return circuit. For example, assuming that the rating power of the power-variable type constant-speed compressor is set to 4 horsepower, the rating power of the constant-speed compressor is set to 6 horsepower, the power reduction of the capacity-variable type constant-speed compressor by the power save mechanism is set to 2 horsepower and the power reduction of the refrigerant return circuit is equal to 1 horsepower, the power can be controlled every horsepower in the range of 1 to 10 horsepower (i.e., at 10 stages).

When the refrigerant return circuit as described above is opened, a part of refrigerant after the compression is circulated into the suck-in side refrigerant circuit, and thus the compressor carries out a vain compressor work. For example, when the driving is performed with 9 horsepower, the compression work of 1 horsepower is discarded by the refrigerant return circuit, however, the energy consumption is substantially equal to that when the driving is performed with 10 horsepower. Accordingly, an energy loss which is equal to or more than that of the inverter occurs, and this is a factor of making it difficult to use the capacity-variable type constant-speed compressor. Besides, it may be considered that no refrigerant circuit is provided and the power control is performed only the power same mechanism. In this case, in the construction of the above compressor, the power control is performed every 2 horsepower (i.e., at five stages). Therefore, in the air conditioner, overshoot or hunting of room temperature occurs if the power demand at the user side is small (for example, about 1 to 3 horsepower), and thus comfortableness of a user in a room to be air-conditioned may be lost.

SUMMARY OF THE INVENTION

The present invention has been implemented in view of the foregoing situation, and has an object to provide a compressor which can perform power control at multistage while promoting reduction in energy consumption, and an air conditioner having the compressor.

In order to attain the above object, according to a first aspect of the present invention, a multi-rotor type compressor comprising plural compression elements, each compression element including a rotor which rotates eccentrically in a cylinder and a vane which is in sliding contact with the outer peripheral surface of the rotor to partition the inner space of the cylinder into a suck-in space and a compression space, is characterized by further comprising power save means which includes an intercommunication path through which the compression space of one compression element is allowed to intercommunicate with the suck-in space of another compression element at a predetermined phase, an interception valve for intercepting the flow of fluid in the intercommunication path, and a check valve which is provided in the intercommunication path and allows the fluid to flow only in one direction.

According to the first aspect of the present invention, when the interception valve of the power save means is closed, each compression element performs the overall compression work, and the compressor is driven with the rating power. On the other hand, when the interception valve is opened, the fluid flows from the compression space of one compression element to the suck-in space of another compression element by the action of the check valve provided in the intercommunication path, and thus the compressor is driven while power-saved.

The compressor according to the first aspect of the present invention may be designed so that the plural compression elements are different in excluded volume.

Further, the compressor may further include compression stop means which is provided to at least one of the compression elements and adapted to intercommunicate the suck-in space and the compression space of the compression element to each other.

According to the above compression, when the compression stop means is not actuated, each compression element performs the overall compression work, and the compressor is driven with the rating (full) power. On the other hand, when the compression stop means provided to a compression element is actuated, the compression element concerned performs no compression work, and thus the compressor is driven while the power corresponding to the excluded volume of the compression element concerned is saved.

Still further, the compressor according to the present invention may include: plural compression elements, each compression element including a rotor which rotates eccentrically in a cylinder and a vane which is in sliding contact with the outer peripheral surface of the rotor to partition the inner space of the cylinder into a suck-in space and a compression space; power save means including an intercommunication path through which the compression space of one compression element is allowed to intercommunicate with the suck-in space of another compression element at a predetermined phase, an interception valve for intercepting the flow of fluid in the intercommunication path, and a check valve which is provided in the intercommunication path and allows the fluid to flow only in one direction; and compression stop means which is provided to at least one of the compression elements and adapted to intercommunicate the suck-in space and the compression space of the compression element to each other.

According to the construction of the above compressor, the compressor is driven not only with the rating power, but also while the power thereof is saved at plural stages (levels).

According to a second aspect of the present invention, an air conditioner having a multi-rotor type compressor comprising plural compression elements, each compression element including a rotor which rotates eccentrically in a cylinder and a vane which is in sliding contact with the outer peripheral surface of the rotor to partition the inner space of the cylinder into a suck-in space and a compression space, is characterized in that the compressor includes power save means comprises an intercommunication path through which the compression space of one compression element is allowed to intercommunicate with the suck-in space of another compression element at a predetermined phase, an interception valve for intercepting the flow of fluid in the intercommunication path, and a check valve which is provided in the intercommunication path and allows the fluid to flow only in one direction.

The above compressor may be designed so that the plural compression elements are different in excluded volume.

The above compressor may further comprise compression stop means which is provided to at least one of the compression elements and adapted to intercommunicate the suck-in space and the compression space of the compression element.

Further, the above compressor may include: plural compression elements, each compression element including a rotor which rotates eccentrically in a cylinder and a vane which is in sliding contact with the outer peripheral surface of the rotor to partition the inner space of the cylinder into a suck-in space and a compression space; power save means including an intercommunication path through which the compression space of one compression element is allowed to intercommunicate with the suck-in space of another compression element at a predetermined phase, an interception valve for intercepting the flow of fluid in the intercommunication path, and a check valve which is provided in the intercommunication path and allows the fluid to flow only in one direction; and compression stop means which is provided to at least one of the compression elements and adapted to intercommunicate the suck-in space and the compression space of the compression element to each other.

According to the air conditioner of the second aspect of the present invention, for example, a constant-speed compressor having two compression elements is disposed in an outdoor unit, power save means for moving refrigerant between both the compression elements, and compression stop means is provided to each compression element, whereby the driving control of both the constant-speed compressors, and the driving control of the power save means and the compression stop means are performed to implement the multistage power control without any refrigerant circuit which causes energy loss.

DETAILED DESCRIPTION OF THE PREFERRED EMBODIMENTS

Preferred embodiments according to the present invention will be described with reference to the accompanying drawings.

Figure 1:
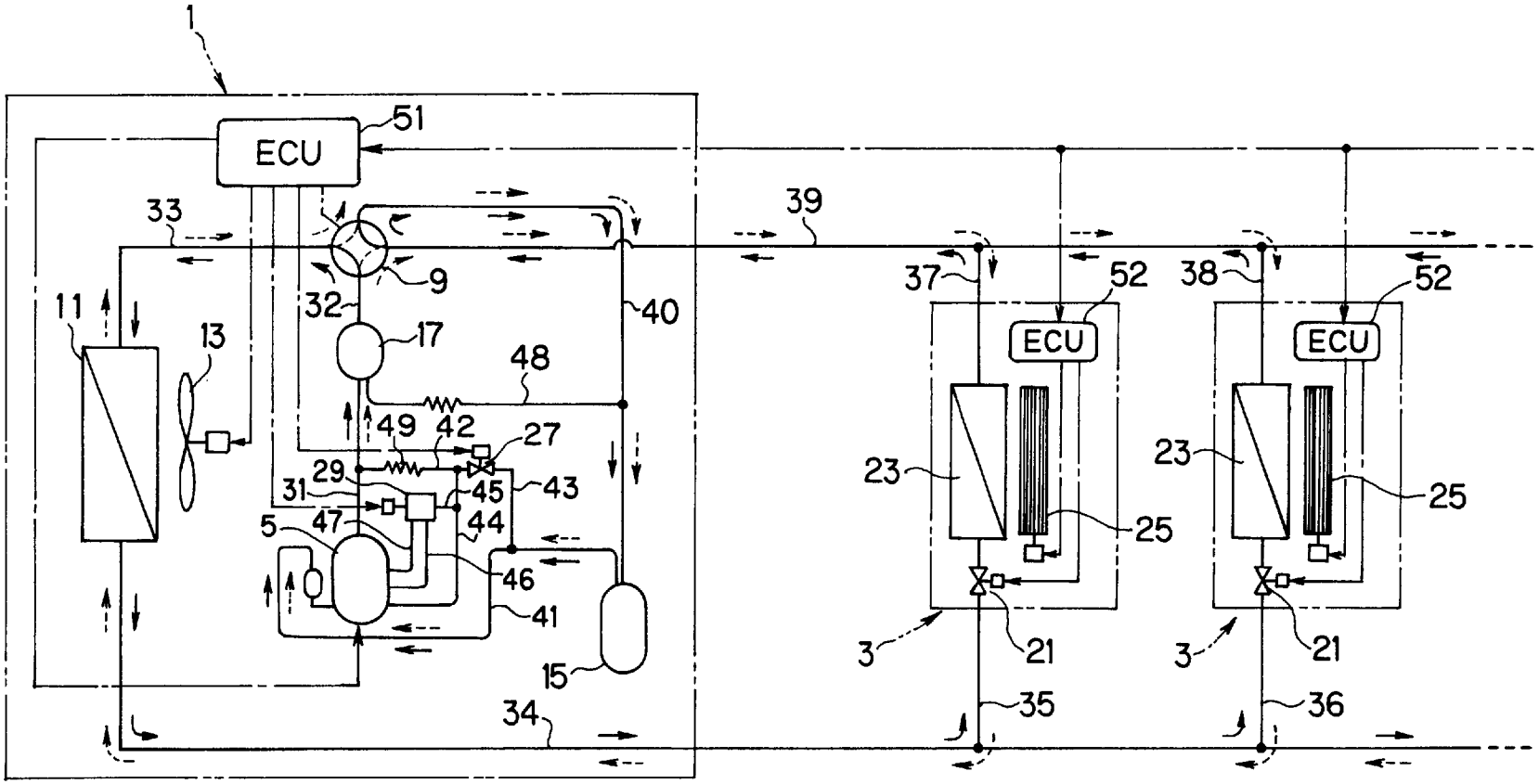
FIG. 1 is a refrigerant circuit diagram and an electrical circuit diagram according to a first embodiment of an air conditioner of the present invention.

FIG. 1 is a schematic diagram showing an air conditioner comprising one outdoor unit 1 and plural indoor units 3. In FIG. 1, a refrigerant circuit is represented by a solid line, and an electrical circuit is represented by a one-dotted chain line.

In the outdoor unit 1 are disposed a compressor 5, an electromagnetic type four-way change-over valve 9, an outdoor heat exchanger 11, an electrically-driven fan 13, an accumulator 15, an oil separator 17, etc. Further, in the indoor unit 3 are disposed an electrically-driven expansion valve 21, an indoor heat exchanger 23, an electrically-driven 25, etc. The elements constituting the refrigerant circuit are connected to one another through refrigerant pipes 31 to 48 through which gas refrigerant or liquid refrigerant flows. In FIG. 1, reference numeral 27 represents a normally-closed type electromagnetic opening/closing valve (hereinafter referred to as "first electromagnetic valve"), and reference numeral 29 represents a 3-position 3-port type electromagnetic change-over valve (hereinafter referred to as "second electromagnetic valve"). These valves are provided to drive the power save mechanism as described later.

An outdoor side control unit (hereinafter referred to as "outdoor ECU") comprising a CPU, an input/output interface, a ROM, a RAM, etc. is disposed in the outdoor unit 1. The outdoor ECU 51 controls the driving of both the compressors 5, 7, the four-way change-over valve 9, the electrically-driven fan 13 and the first and second electromagnetic valves 27 and 29 on the basis of a built-in control program and input information from various sensors, etc. (not shown).

Further, an indoor side control unit (hereinafter referred to as "indoor ECU") 52 comprising a CPU, an input/output interface, a ROM, a RAM, etc. is disposed in the indoor unit 3. The indoor ECU 52 controls the driving of the electrically-driven expansion valve 21 and the electrically-driven fan 25 on the basis of a built-in control program and input signals from various sensors, etc., and also receives/transmits signals from/to the outdoor ECU 51.

In this embodiment, the compressor 5 comprises an electrically-driven twin rotor type constant-speed compressor having a pair of upper and lower rotational compression elements, and the rating output of the compressor is set to 4 horsepower. The compressor 5 is provided with a power save mechanism shown in FIG. 2 and a compression stop mechanism shown in FIG. 4, and the compression work of the compressor 5 is varied at 8 stages (levels) by the actuation of the power save mechanism and the compression stop mechanism.

Next, the structure and the operation of the power save mechanism of this embodiment will be described.

Figure 2:
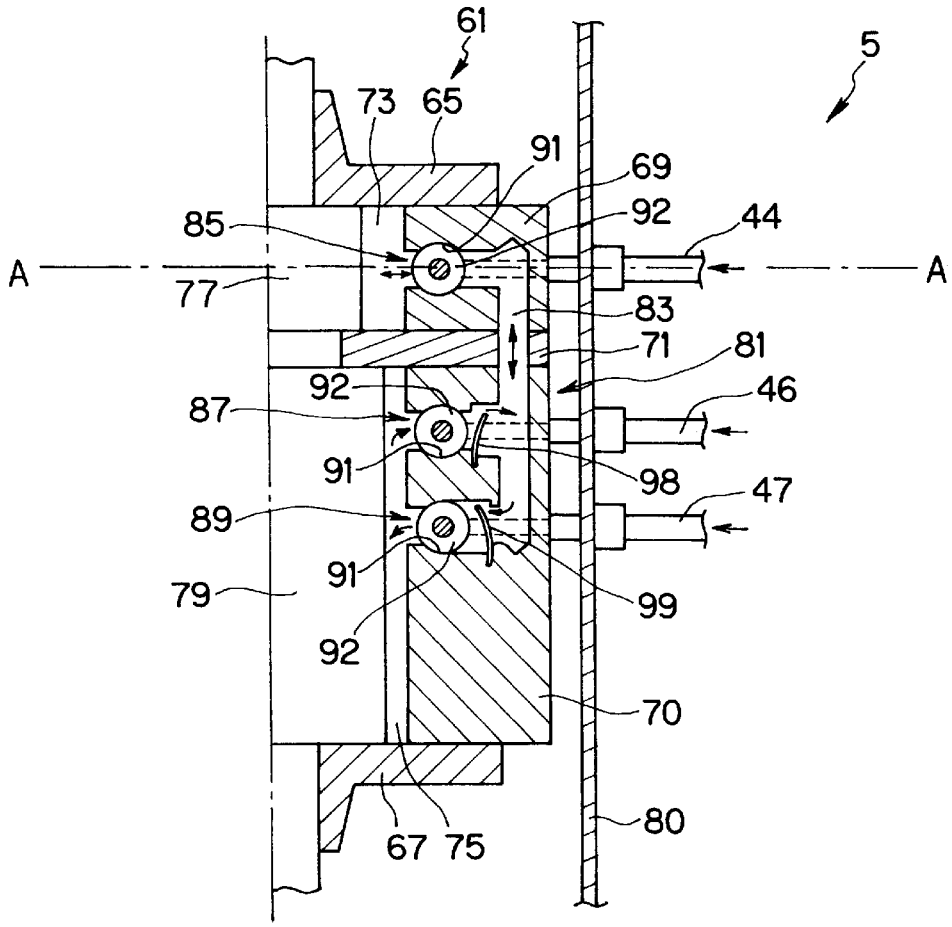
FIG. 2 is a partial longitudinally-sectional view showing the structure of a power save mechanism which is provided to a compressor shown in FIG. 1.

As shown in the partial longitudinally-sectional view of FIG. 2, the compression mechanism 61 of the compressor 5 comprises a pair of upper and lower cylinders 69, 70 which are sandwiched between a main frame 65 and a bearing plate 67, a pair of upper and lower cylinder chambers 73, 75 which are defined and partitioned by the cylinders 69, 70 and an intermediate plate 71, and a pair of upper and lower rotors 77, 79 which eccentrically rotate along the inner peripheral surfaces of the cylinders 73, 75 while keeping a phase difference of 180° therebetween.

In this case, both the rotors 77, 79 have the same diameter, however, the upper rotor 77 and the lower rotor 79 are designed to have a height ratio of 1:3. Accordingly, the excluded volume ratio of the rotors 77, 79 in the upper and lower cylinder chambers 73 and 75 is set to 1:3. Therefore, the upper rotational compression element has a rating output of 1 horsepower, and the lower rotational compression element has a rating output of 3 horsepower. In FIG. 2, reference numeral 80 represents a compressor casing.

The power save mechanism 81 selectively intercommunicates both the cylinder chambers 73, 75 with each other by a prescribed intercommunication member (a member which is deviated in phase from the vane as described later by 180°), and it includes an intercommunication path containing an intercommunication hole 83 which is formed in the vertical direction on the outer peripheral portions of the cylinders 69, 70 and the intermediate plate 71, a first valve hole 85 which intercommunicates the upper cylinder chamber 73 and the intercommunication hole 83, and second and third valve holes 87 and 89 which intercommunicate the lower cylinder chamber 75 and the intercommunication hole 83.

Figure 3:
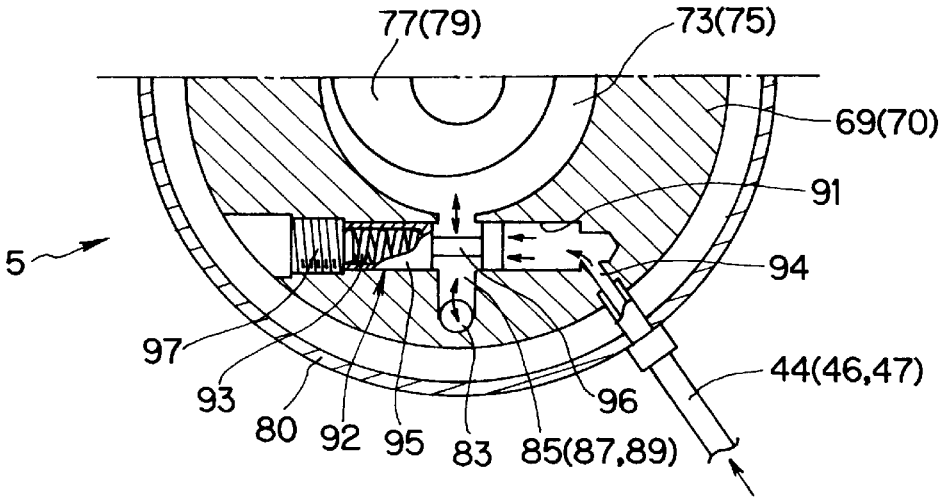
FIG. 3 is a cross-sectional view which is taken along a line A—A in FIG. 2.

A spool valve hole 91 is formed in each valve hole 85, 87, 89 so that the spool valve hole 91 intersects to the corresponding valve hole in the horizontal direction as shown in FIG. 3 (cross-sectional view of A—A of FIG. 2), and a spool valve 92 and a valve spring (compression coil spring) 93 are accommodated in the spool valve hole 91. Further, a refrigerant gas introducing hole 94 is formed at the right end of each spool valve hole 91, and refrigerant gas from each of first to third power save pipes 44, 46, 47 is introduced into each spool valve hole 91 through the refrigerant gas introducing hole 94.

In this embodiment, when the low-pressure refrigerant gas is introduced from the refrigerant gas introducing hole 94, the valve hole 85, 87, 89 is closed by the large-diameter portion 95 of the spool valve 92. On the other hand, when the refrigerant gas at a pressure which is equal to or higher than a predetermined value (for example, 10% of the maximum output pressure of the compressor 5) is introduced from the refrigerant gas introducing hole 94, as shown in FIG. 3, the valve spring 93 is compressed, and the spool valve 92 is shifted to the left, whereby the valve hole 85, 87, 89 is opened through a small-diameter portion 96 of the spool valve 92. In FIG. 3, reference numeral 97 represents a spring plug.

Lead valve type check valves 98, 99 are disposed in the second valve hole 87 and the third valve hole 89, respectively. The check valve 98 in the second valve hole 87 allows the gas refrigerant to flow from the lower cylinder chamber 75 to the intercommunication hole 83 in only one direction, and the check valve 99 in the third valve hole 89 allows the gas refrigerant to flow from the intercommunication hole 83 to the lower cylinder chamber 75 in only one direction.

The above-described first electromagnetic valve 27 is interposed between the first and second bypass pipes 42, 43 for intercommunicating the refrigerant pipe 31 at the discharge side of the compressor 5 and the refrigerant pipe 41 at the suck-in side of the compressor 5 with each other. The first power save pipe 44 which intercommunicates with the refrigerant gas introducing hole 94 at the first valve hole 85 side is connected to the first bypass pipe 42, and a capillary tube 49 for reducing the flow amount of the gas refrigerant is disposed at the upstream side of the connection portion.

Further, the second electromagnetic valve 29 is a 3-position 3-port change-over electromagnetic valve as described above, and it is designed so as to mutually intercommunicate the first to third ports with one another at a first position, intercommunicate the first and second ports with each other at a second position and intercommunicate the first and third ports with each other at a third position. The first port of the second electromagnetic valve 29 is connected to a refrigerant pipe 45 which is branched from the first power save pipe 44, the second port is connected to the second power save pipe 46 and the third port is connected to the third power save pipe 47.

In this embodiment, when the power save mechanism 81 is actuated, the outdoor ECU 51 closes the first electromagnetic valve 27 to intercept the intercommunication between the first bypass pipe 45 and the second bypass pipe 46. Upon this interception operation, the high-pressure refrigerant gas is introduced from the discharge-side refrigerant pipe 31 through the first bypass pipe 42 and the first power save pipe 44 into the spool valve hole 91 at the first valve hole 85 side, and the spool valve 92 is actuated as described above to open the first valve hole 85.

At the same time when the first electromagnetic valve 27 is closed, the outdoor ECU 51 switches the second electromagnetic valve 29 to any one of the first to third positions. For example, when the second electromagnetic valve 29 is switched to the first position, the high-pressure refrigerant gas introduced in the first power save pipe 44 is introduced through the second and third power save pipes 46, 47 into the spool valve holes 91 of the second and third valve holes 87, 89 respectively, whereby the second and third valve holes 87 and 89 are opened. In this state, the upper cylinder chamber 73 and the lower cylinder chamber 75 intercommunicate with each other through each valve hole 85, 87, 89 and the intercommunication hole 83, and the gas refrigerant flows from the compression space of one cylinder chamber 73 (75) to the suck-in space of the other cylinder chamber 75 (73), whereby a half of the compression work in both the cylinder chambers 73, 75 (that is, 50%=2 horsepower as the whole compression mechanism 61) can be saved.

Further, when the outdoor ECU 51 switches the second electromagnetic valve 29 to the second position, the high-pressure refrigerant gas introduced into the first power save pipe 44 is introduced through the second power save pipe 46 into the spool valve hole 91 of the second valve hole87 side to open the second valve hole 87. Under this state, the upper cylinder chamber 73 and the lower cylinder chamber 75 intercommunicate with each other through the first and second valve holes 85, 87 and the intercommunication hole 83, and the gas refrigerant flows from the compression space of the lower cylinder chamber 75 to the suck-in space of the upper cylinder chamber 73 by the action of the check valve 98 in only one direction, whereby a half of the compression work in the lower cylinder chamber 75 (that is, 37.5%=1.5 horsepower as the whole compression mechanism 61) can be saved.

Further, when the outdoor ECU 51 switches the second electromagnetic valve 29 to the third position, the high-pressure refrigerant gas introduced into the first power save pipe 44 is introduced into the spool valve hole 91 of the third valve hole 89 through the third power save pipe 47 to open the third valve hole 87. In this state, the upper cylinder chamber 73 and the lower cylinder chamber 75 intercommunicate with each other through the first and third valve holes 85, 89 and the intercommunication hole 83, and the gas refrigerant flows from the compression space of the upper cylinder chamber 73 to the suck-in space of the lower cylinder chamber 75 by the action of the check valve 99, whereby a half of the compression work in the upper cylinder chamber 73 (that is, 12.5%=0.5 horsepower as the whole compression mechanism 61) can be saved.

On the other hand, when the power save mechanism 81 is stopped, the outdoor ECU 51 opens the first electromagnetic valve 27, and switches the second electromagnetic valve 29 to the first position, whereby each spool valve hole 91 intercommunicates with the suck-in side refrigerant pipe 43 through the first to third power save pipes 44, 46, 47 and the second bypass pipe 43. Since the supply amount of the high-pressure refrigerant gas from the first bypass pipe 42 is reduced to an extremely small value by the action of the capillary tube 49, the high-pressure gas refrigerant in each spool valve hole 91 flows out to the suck-in side refrigerant pipe 43, and the spool valve 92 is returned to the original position, thereby closing the first to third valve holes 85, 87, 89.

Through the above operation, the overall compression work of both the cylinder chambers 73, 75 is performed, and the compressor 5 generates the rating output (in this embodiment, 4 horsepower). The capillary tube 49 also functions to reduce the amount of the high-pressure refrigerant gas flowing from the discharge-side refrigerant pipe 31 to the suck-in side refrigerant pipe 41 to an extremely small value when the discharge-side refrigerant pipe 31 intercommunicates with the suck-in side refrigerant pipe 41 through the first and second bypass pipes 42, 43.

Next, the structure and the operation of the compression stop mechanism according to this embodiment will be described.

Figure 4:
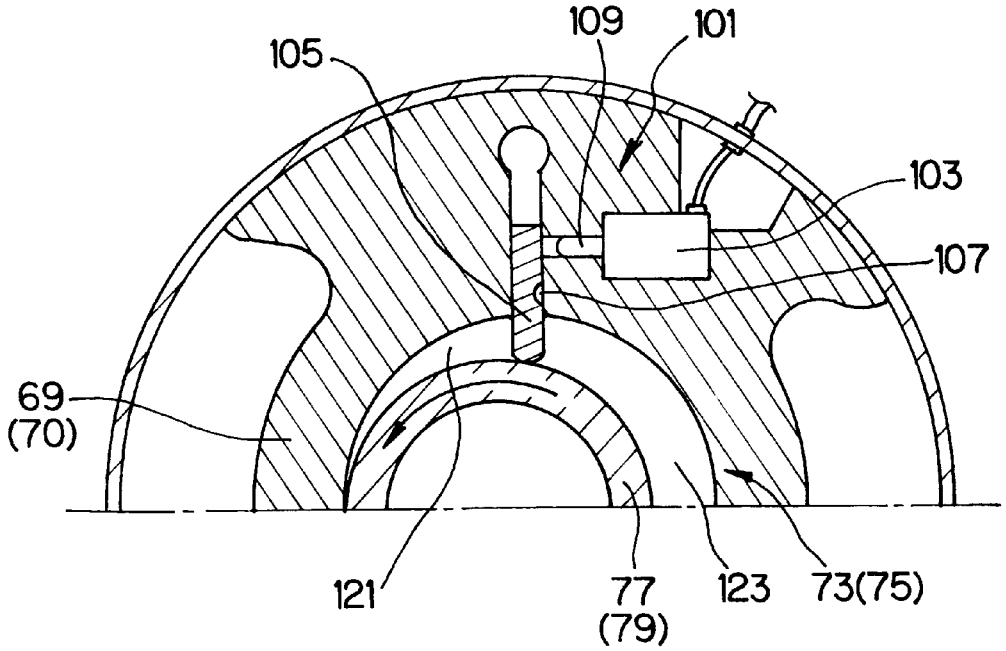
FIG. 4 is a partial cross-sectional view showing a state where a compression stop mechanism provided to the compressor shown in FIG. 1 is not actuated.

As shown in the partial cross-sectional view of FIG. 4, a compression stop mechanism 101 is fabricated in each of both the cylinders 69, 70 of the compressor 5. The compression stop mechanism 101 includes an electromagnetic stopper 103 which is embedded in each of the cylinders 69 and 70, and an engaging recess portion 107 which is formed in the vane 105. The electromagnetic stopper 103 contains a solenoid type actuator (not shown), and a lock pin 109 thereof is projected to the left in FIG. 4 when the electromagnetic stopper 103 is actuated.

During the normal operation, the lock pin 109 of the electromagnetic stopper 103 is separated from the engaging recess portion 107 of the vane 105 as shown in FIG. 4, and the vane 105 is pressed against the outer peripheral surface of a rotor 77 (rotor 79) by a vane spring (not shown), whereby the upper cylinder chamber 73 (lower cylinder chamber 75) is partitioned into a suck-in space 121 and a compression space 123 and the compression work is performed by the rotation of the rotor 77 (rotor 79).

When the electromagnetic stopper 103 is driven (the solenoid is excited) with driving current from the outdoor ECU 51, the lock pin 109 is projected to the left in FIG. 4, and the tip thereof is engaged with the engaging recess portion 107 of the vane 105, whereby the vane 105 is prohibited from being projected from the inner peripheral surface of the upper cylinder 69 (lower cylinder chamber 75) and thus the suction and compression work of the refrigerant is never performed in the upper cylinder chamber 73 (lower cylinder chamber 75).

Accordingly, according to the compressor 5 of this embodiment, when the compression stop mechanism 101 of the upper cylinder 69 is actuated, the compressor work corresponding to 1 horsepower is saved. Further, when the compression stop mechanism 101 of the lower cylinder 70 is actuated, the compression work corresponding to 3 horsepower is saved. When the electromagnetic stopper 103 is actuated, the lock pin 109 is instantaneously projected to the left. Therefore, the timing at which the tip of the lock pin 109 is engaged with the engaging recess portion 107 is set to the instantaneous time at which the vane 105 is pushed into the upper cylinder 69 Bower cylinder 70) by the rotor 77.

Next, the flow of the refrigerant in cooling operation will be described.

The gas refrigerant which is sucked in from the accumulator 15 through the refrigerant pipe 41 to the compressor 5 is adiabatically compressed into high-temperature and high-pressure gas refrigerant, and then discharged from the compressor 5. The high-pressure gas refrigerant thus discharged is passed through the refrigerant pipe 31, the oil separator 17 and the refrigerant pipe 32 and then the course of the refrigerant is controlled by the four-way change-over valve 9. Thereafter, the refrigerant flows through the refrigerant pipe 33 into the outdoor heat exchanger 11. The high-temperature and high-pressure gas refrigerant is cooled and condensed into liquid refrigerant by the outside air while passing in the outdoor heat exchanger 11. Thereafter, the liquid refrigerant flows through the refrigerant pipes 34 to 36 into the electrically-driven expansion valve 21 of each indoor unit 3.

The flow amount of the liquid refrigerant is controlled by the electrically-driven expansion valve 21, and then flows into the indoor heat exchanger 23 to be vaporized into gas refrigerant while passing in the indoor heat exchanger 23. The indoor air which is blown from the electrically-driven fan 25 is cooled by the vaporization latent heat in this vaporization process of the refrigerant. At this time, the indoor ECU 52 controls the rotational number of the electrically-driven fan 7 on the basis of the difference between the set temperature and the room temperature, and also controls the valve opening degree of the electrically-driven expansion valve 21 (the step number of a step motor for driving a valve plug) so that the difference between the inlet side refrigerant temperature and the outlet side refrigerant temperature of the indoor heat exchanger 23 is equal to a predetermined value (for example, 0 to 1°).

The gas refrigerant which is vaporized in the indoor heat exchanger 23 is passed through the refrigerant pipes 37 to 39, the four-way change-over valve 9 and the refrigerant pipe 40 and flows into the accumulator 15, and then sucked from the refrigerant pipe 41 by the compressor 5 again.

On the other hand, in heating operation, the four-way change-over valve 9 is switched as indicated by a broken line, and the flow of the refrigerant is opposite to that in cooling operation as indicated by an arrow of broken line. That is, the high-temperature and high-pressure gas refrigerant discharged from the compressor 5 is introduced into the indoor heat exchanger 23, and then condensed into liquid refrigerant while passing through the indoor heat exchanger 23. The indoor air which is blown from the electrically-driven fan 25 is heated by the condensation latent heat of the refrigerant in the condensation process. Subsequently, the liquid refrigerant is introduced into the outdoor heat exchanger 11, and heated to be vaporized into gas refrigerant by the outside air while passing through the outdoor heat exchanger 11. Thereafter, the gas refrigerant is sucked from the accumulator 15 into the compressor 5 again.

Next, the process of the power (capacity) control of this embodiment will be described with reference to FIGS. 6 to 13.

In these figures, it is assumed for convenience's purpose of description that the upper cylinder 69 and the lower cylinder 70 are disposed so as to be aligned in the vertical direction, and the difference in volume between the upper and lower cylinders 69 and 70 is illustrated as the difference in area on the plane. When the driving of the air conditioner is started, the outdoor ECU 51 determines a target compression work on the basis of an input signal from each indoor ECU 52 to actuate the compressor (i.e., an actuating magnet switch is turned on), and also the power save control and the compression stop control are performed.

Figure 14:
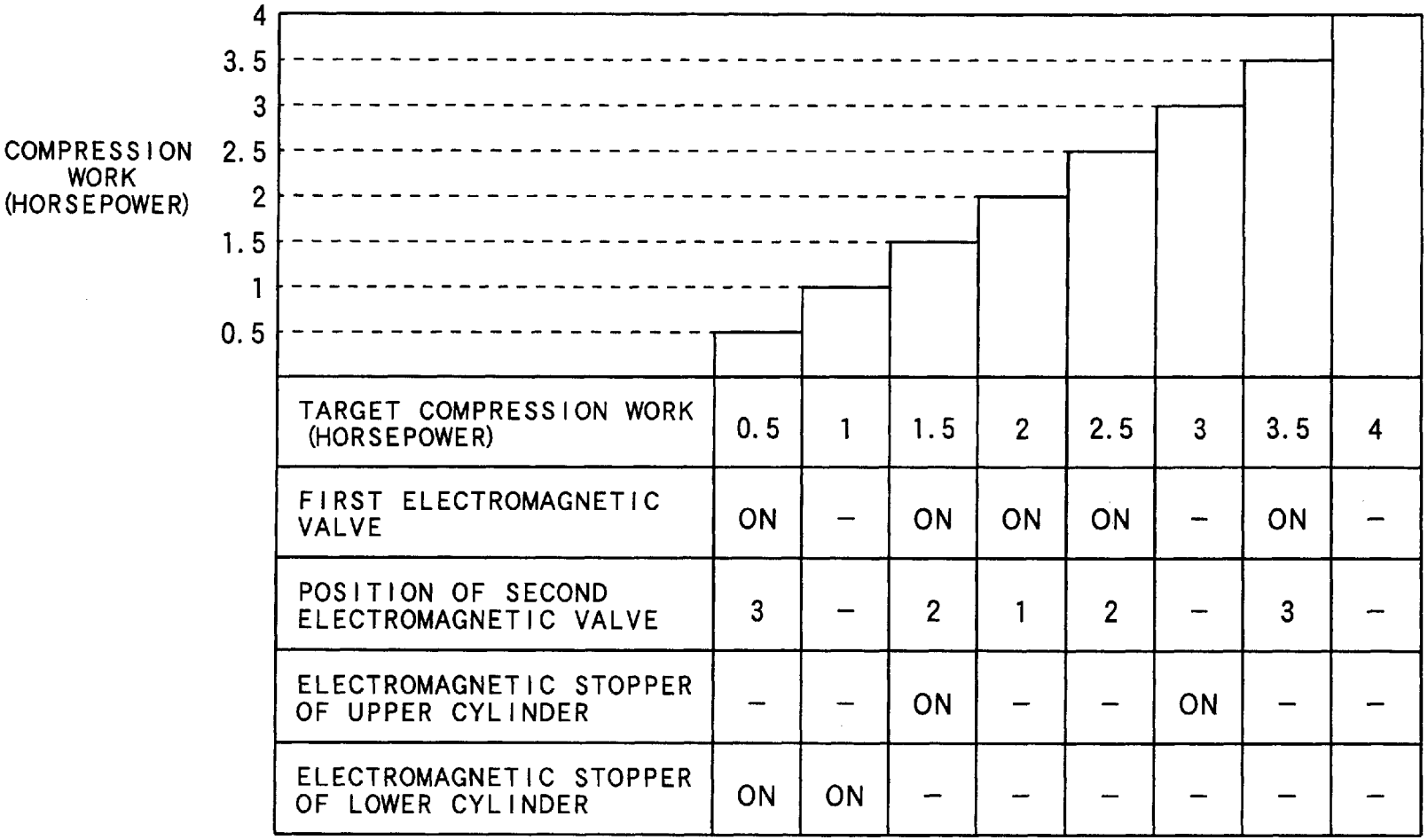
FIG. 14 is a diagram showing the relationship between a target compression work and the operation of each mechanism.

The specific power control operation will be described in detail. As shown in FIG. 14, when the target compression work is set to 4 horsepower, the outdoor ECU 51 opens the first electromagnetic valve 27, and turns off the electromagnetic stopper 103. Accordingly, since neither the power save mechanism 81 nor the compression stop mechanism 101 are actuated, a predetermined compression work is performed in each of the cylinder chambers 73, 75 of the compressor 5, and the compression work of 4 horsepower is performed as the outdoor unit 1.

Figure 7:
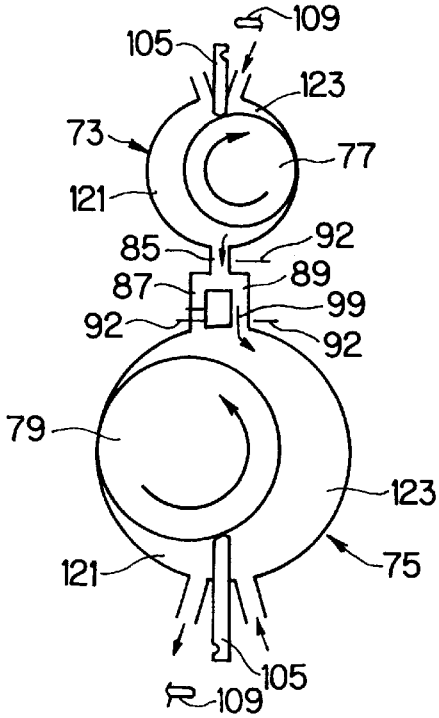
FIG. 7 is a schematic diagram showing the action of the compressor.

When the target compression work is set to 3.5 horsepower, the outdoor ECU 51 intercepts the first electromagnetic valve 27, and switches the second electromagnetic valve 29 to the third position. Accordingly, the gas refrigerant is allowed to flow from the compression space 123 of the upper cylinder chamber 73 to the suck-in space 121 of the lower cylinder chamber 75 by the power save mechanism 81 as shown in FIG. 7, so that 0.5 horsepower is saved as described above. As a result, the entire horsepower of the outdoor unit 1 is reduced from 4.0 horsepower by 0.5 horsepower, that is, the whole outdoor unit 1 performs a compression work of 3.5 horsepower.

Figure 8:
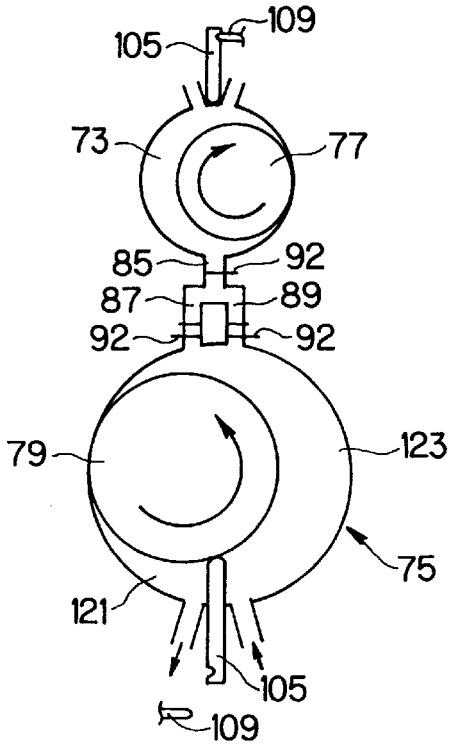
FIG. 8 is a schematic diagram showing the action of the compressor.
Figure 9:
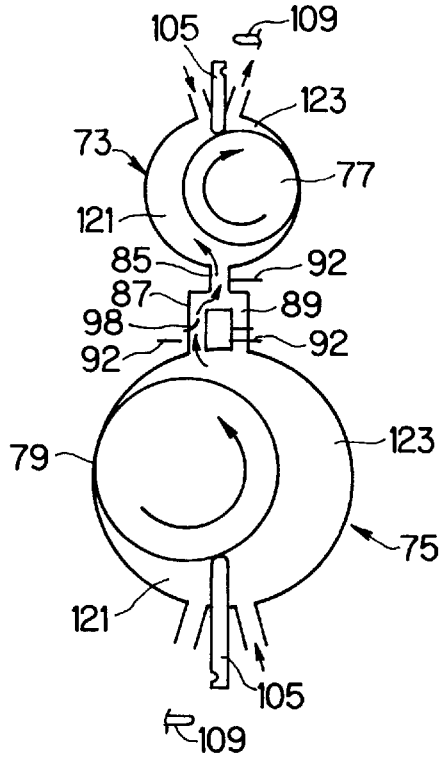
FIG. 9 is a schematic diagram showing the action of the compressor.

When the target compression work is set to 3 horsepower, the outdoor ECU 51 opens the first electromagnetic valve 27, and drives the electromagnetic stopper 103 of the upper cylinder 69. Accordingly, as shown in FIG. 8, no refrigerant suck-in and compression work is carried out by the action of the compression stop mechanism 101 in the upper cylinder chamber 73, and 1 horsepower is saved as described above. As a result, 1 horsepower is reduced from 4 horsepower, and thus the entire horsepower of the outdoor unit 1 is reduced to 3 horsepower (i.e., the outdoor unit 1 performs a compression work of 3 horsepower).

When the target compression work is set to 2.5 horsepower, the outdoor ECU 51 intercepts the first electromagnetic valve 27, and switches the second electromagnetic valve 29 to the second position. Accordingly, as show in FIG. 9, the gas refrigerant is allowed to flow from the compression space 123 of the lower cylinder chamber 75 to the suck-in space 121 of the upper cylinder chamber 73 by the power save mechanism 81, and 1.5 horsepower is saved as described above. As a result, 1.5 horsepower is reduced from 4 horsepower as the entire outdoor unit 1, and the outdoor unit 1 performs a compression work of 2.5 horsepower.

Figure 10:
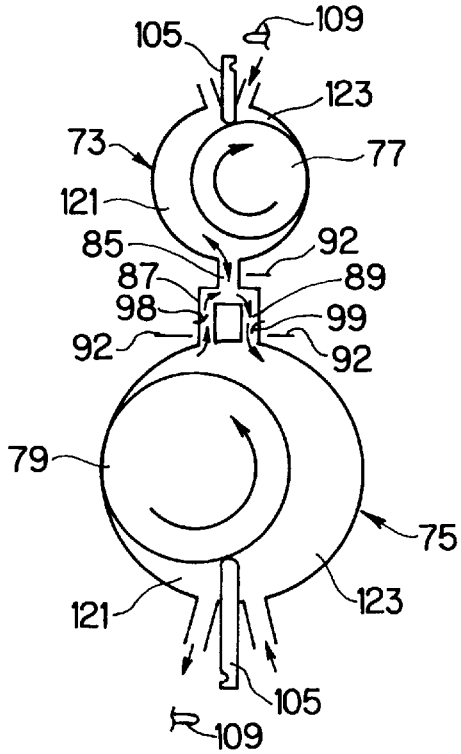
FIG. 10 is a schematic diagram showing the action of the compressor.

When the target compression work is set to 2 horsepower, the outdoor ECU 51 intercepts the first electromagnetic valve 27, and switches the second electromagnetic valve 29 to the first position. Accordingly, by the power save mechanism 81, the gas refrigerant is allowed to flow from the compression space 123 of the upper cylinder chamber 73 to the suck-in space 121 of the lower cylinder chamber 75, and also the gas refrigerant is allowed to flow from the compression space 123 of the lower cylinder chamber to the suck-in space 121 of the upper cylinder chamber 73 as shown in FIG. 10, whereby 2 horsepower is saved as described above. As a result, 2 horsepower is reduced from 4 horsepower as the entire outdoor unit 1, and a compression work of 2 horsepower is performed.

Figure 11:
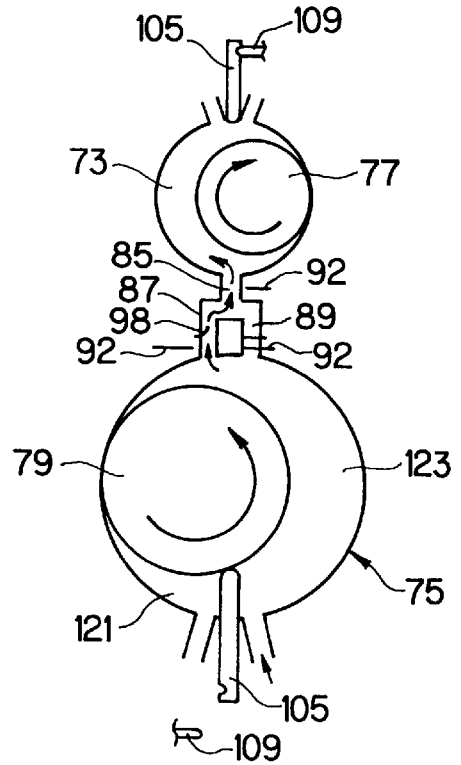
FIG. 11 is a schematic diagram showing the action of the compressor.

When the target compression work is set to 1.5 horsepower, the outdoor ECU 51 closes the first electromagnetic valve 27 and switches the second electromagnetic valve 29 to the second position, and also drives the electromagnetic stopper 103 of the upper cylinder 69. Accordingly, by the action of the power save mechanism 81 and the compression stop mechanism 101, the gas refrigerant is allowed to flow from the compression space 123 of the lower cylinder chamber 75 to the upper cylinder chamber 73, and no refrigerant suck-in and compression work is performed in the upper cylinder chamber 73 as shown in FIG. 11, so that 2.5 horsepower is saved. As a result, 2.5 horsepower is reduced from 4 horsepower as the entire outdoor unit 1, and a compression work of 1.5 horsepower is performed.

Figure 12:
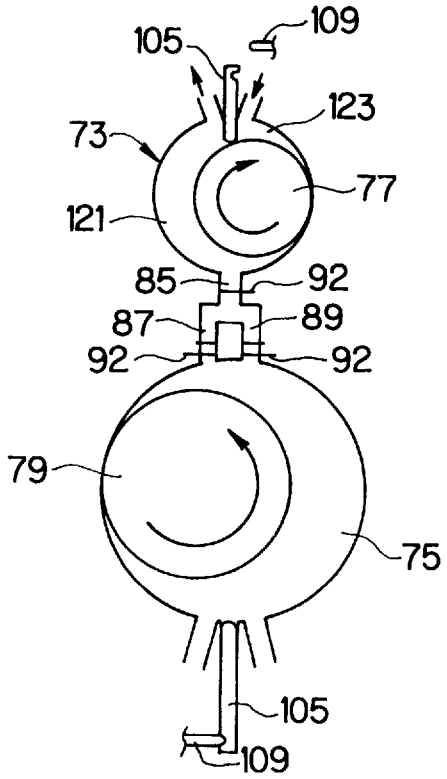
FIG. 12 is a schematic diagram showing the action of the compressor.

When the target compression work is set to 1 horsepower, the outdoor ECU 51 opens the first electromagnetic valve 27, and drives the electromagnetic stopper 103 of the lower cylinder 70. Accordingly, no refrigerant suck-in and compression work is performed by the action of the compression stop mechanism 101 as shown in FIG. 12, so that 3 horsepower is saved as described above. As a result, 3 horsepower is reduced from 4 horsepower as the entire outdoor unit 1, and a compression work of 1 horsepower is performed.

Figure 13:
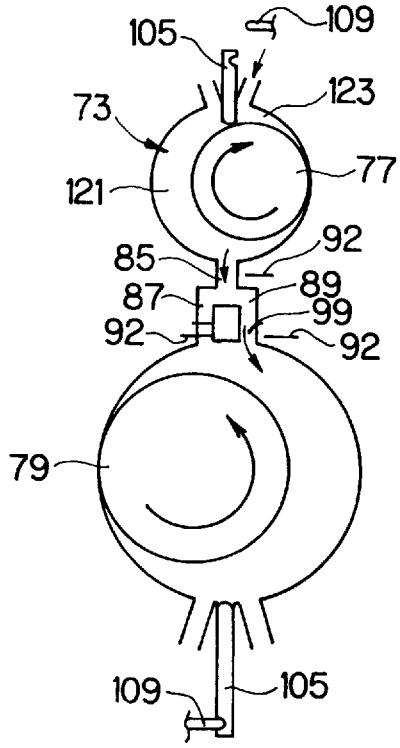
FIG. 13 is a schematic diagram showing the action of the compressor.

When the target compression work is set to 0.5 horsepower, the outdoor ECU 51 closes the first electromagnetic valve 27 and switches the second electromagnetic valve 29 to the third position, and also drives the electromagnetic stopper 103 of the lower cylinder 70. Accordingly, the gas refrigerant is allowed to flow from the compression space 123 of the upper cylinder chamber 73 to the lower cylinder chamber 75, and no refrigerant suck-in and compression work is performed in the lower cylinder chamber 75 by the action of the power save mechanism 81 and the compression stop mechanism 101 as shown in FIG. 13, so that 3.5 horsepower is saved. As a result, 3.5 horsepower is reduced from 4 horsepower as the entire outdoor unit 1, and a compression work of 0.5 horsepower is performed.

As described above, according to this embodiment, the driving of the power save mechanism 81 and the compression stop mechanism 101 is controlled as shown in FIG. 14 to implement the power (capacity) control from 0.5 to 4 horsepower every 0.5 horsepower. This power control is performed without any refrigerant return control which wastes some of the compression work, thereby enhancing the energy efficiency.

In the above-described embodiment, one constant-speed compressor is provided with the power save mechanism and the compression stop mechanism. However, the power save mechanism and the compression stop mechanism may be provided to one of plural constant-speed compressors. Further, in the above-described embodiment, the power save mechanism and the compression stop mechanism are provided to a twin rotor type constant-speed compressor. However, they may be provided to a constant-speed compressor having a triple or more rotor type compression mechanism. With respect to the power save mechanism, various structures may be considered. For example, an intercommunication circuit and an electromagnetic valve may be provided to the outside of the compressor casing. The save amount may be freely set. Further, high-pressure refrigerant gas may be used as a driving source for the compression stop mechanism. Still further, the construction of the refrigerant circuit may be suitably modified without departing the subject matter of the present invention.

Figure 15:
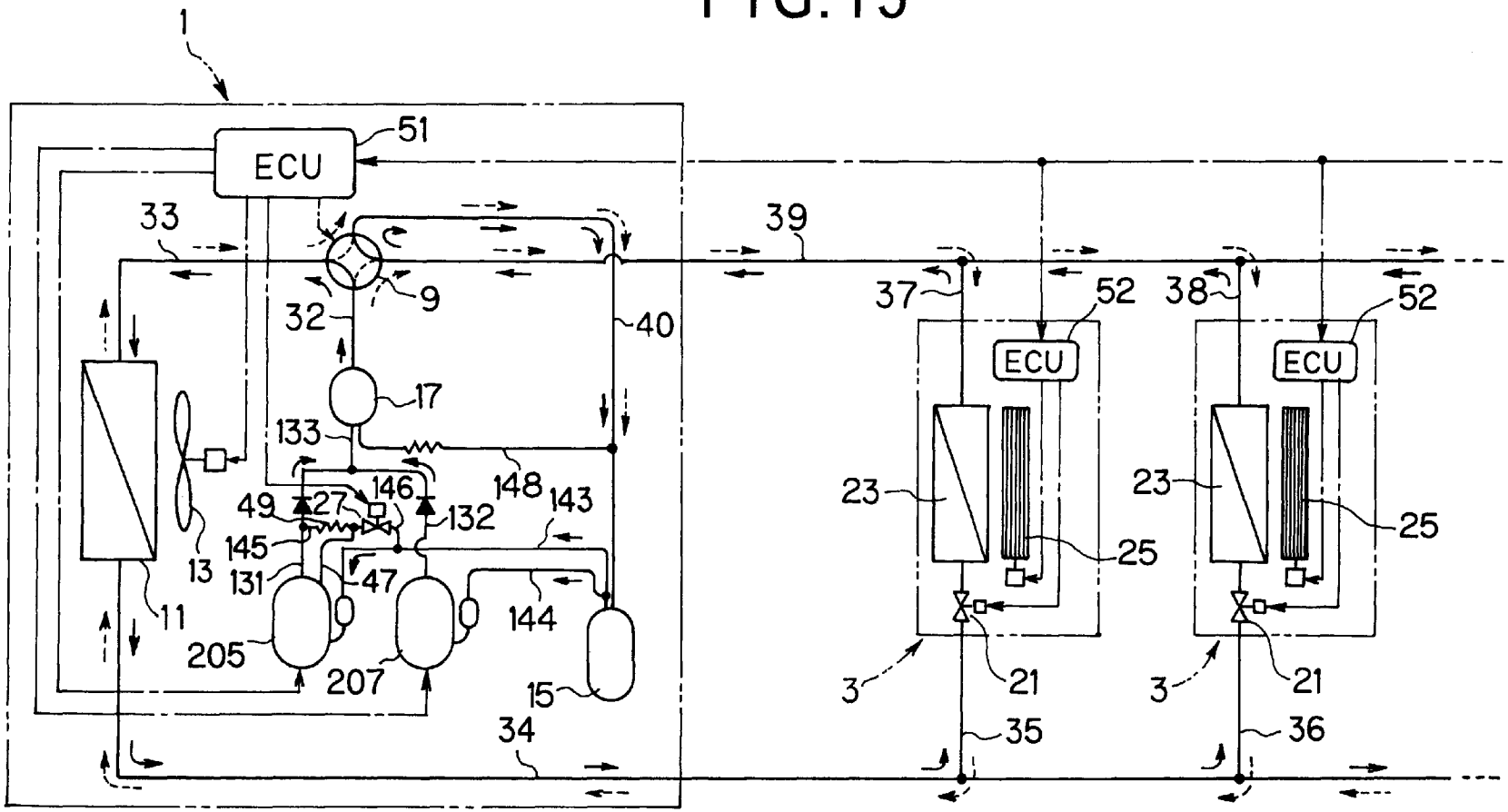
FIG. 15 shows refrigerant and electrical circuit diagrams showing a second embodiment of an air conditioner of the present invention.

FIG. 15 shows an air conditioner according to a second embodiment of the present invention in which two twin rotor type constant-speed compressors are provided, and one of the compressors is provided with a power save mechanism and a compressor stop mechanism. The second embodiment is substantially similar to the first embodiment except that the two compressors are provided and also the power save mechanism has the different structure from that of the first embodiment, and the same elements are represented by the same reference numerals.

In the outdoor unit 1 are disposed first and second compressors 205 and 207, an electromagnetic type four-way change-over valve 9, an outdoor heat exchanger 11, an electrically-driven fan 13, an accumulator 15, an oil separator 17, etc. In the indoor unit 3 are disposed an electrically-driven expansion valve 21, an indoor heat exchanger 23, an electrically-driven fan 25, etc. The parts constituting the refrigerant circuit are connected to one another through refrigerant pipes 32 to 40, 131 to 133 and 143 to 148 which are provided for flow of gas or liquid refrigerant. In FIG. 15, reference numeral 27 represents a normally-closed type electromagnetic valve for driving a power save mechanism as described later.

In the outdoor unit 1 is disposed an outdoor control unit (hereinafter referred to as "outdoor ECU") comprising a CPU, an input/output interface, a ROM, a RAM, etc. Further, The outdoor ECU 51 controls the driving of both compressors 205, 207, a four-way change-over valve 9, an electrically-driven fan 13 and an electromagnetic valve on the basis of a built-in program and input information from various sensors.

The construction of the indoor unit 3 is the same as the first embodiment, and thus the description thereof is omitted from the following description.

In this embodiment, each of the first and second compressors 205 and 207 is an electrically-driven twin rotor type constant-speed compressor having a pair of upper and lower rotational compression elements, and it is assumed that the rating output of the first compressor 205 is set to 4 horsepower and the rating output of the second compressor 207 is set to 6 horsepower. The first compressor 205 is provided with a power save mechanism shown in FIG. 16 and a compression stop mechanism shown in FIG. 17, and the compression work of the first compressor 205 is changed at four stages by the action of the power save mechanism and the compression stop mechanism.

Next, the construction and operation of the power save mechanism of this embodiment will be described.

Figure 16:
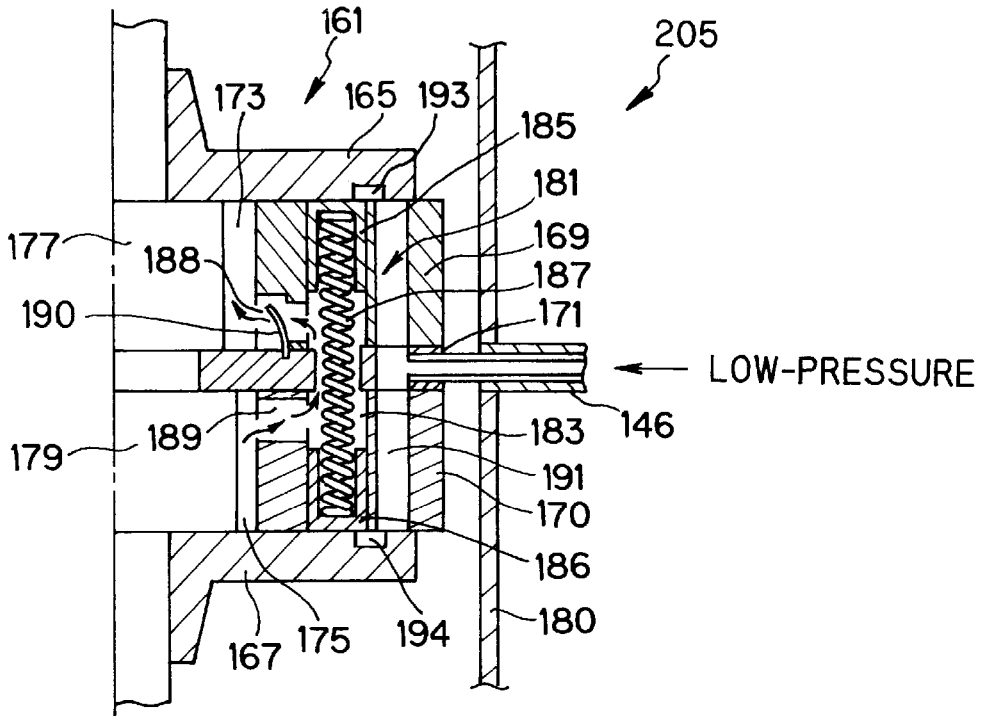
FIG. 16 is a partial longitudinally-sectional view showing the actuation state of a power save mechanism which is provided to the compressor shown in FIG. 15.
Figure 17:
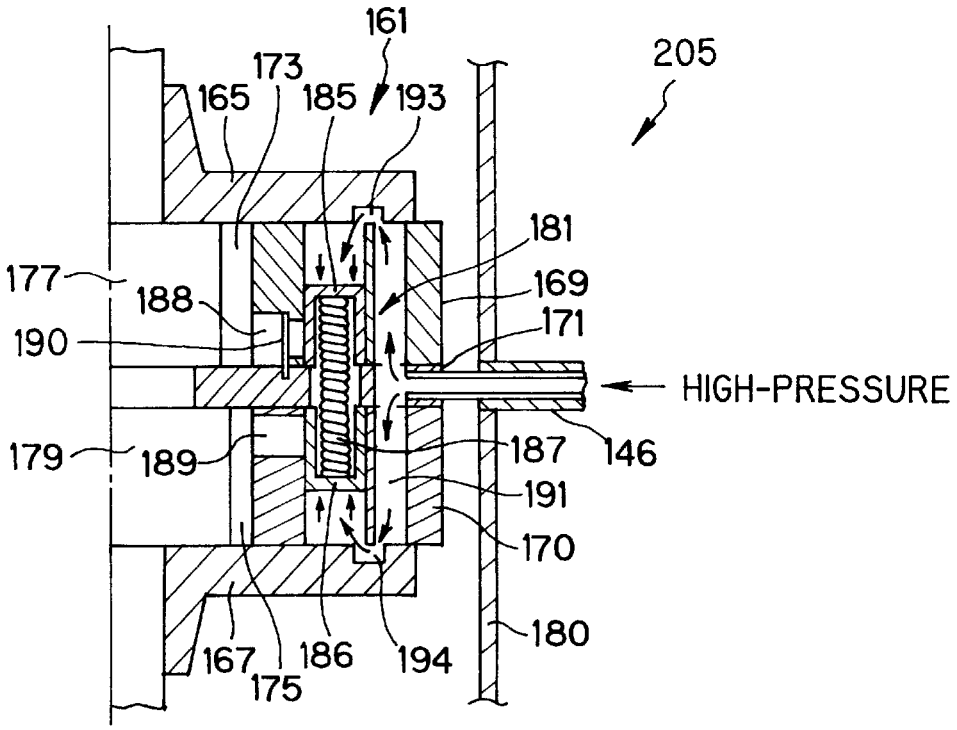
FIG. 17 is a partial longitudinally-sectional view showing the non-actuation state of the power save mechanism shown in FIG. 16.

As shown in FIG. 16, the compression mechanism 161 of the first compressor 205 comprises a pair of upper and lower cylinders 169 and 170 which are sandwiched between a main frame 165 and a bearing plate 167, a pair of upper and lower cylinder chambers 173, 175 which are partitioned by the cylinders 169, 170 and an intermediate plate 171, and a pair of upper and lower rotors 177, 179 which eccentrically rotate along the inner peripheral surfaces of the cylinder chambers 173, 175 while keeping a phase difference of 180° therebetween. In FIGS. 16 and 17, reference numeral 80 represents a compressor casing.

In the power save mechanism 181, both the cylinder chambers 173 and 175 are allowed to intercommunicate with each other by a prescribed intercommunication member (a member which is deviated in phase from a vane as described later by 180°), and it mainly comprises a valve hole 183 which is penetrated in the vertical direction in the outer peripheral portions of the cylinders 169, 170 and the intermediate plate 171, a pair of upper and lower piston valves 185 and 186 which are freely slidably held in the valve hole 183, a valve spring (compression coil spring) 187 for urging the piston valves 185 and 186 so that the piston valves 185 and 186 are separated from each other. In order to form a stopper to the piston valves 185, 186, the inner diameter of the valve hole 183 is set to be smaller than the outer diameter of the piston valves 185, 186. Further, the valve spring 187 is designed so as to be perfectly compressed when high pressure above a predetermined value (for example, 40% of the maximum discharge pressure of the first compressor 5) is applied to the pressure receiving faces of the piston valves 185 and 186.

The valve hole 183 intercommunicate with both the cylinder chambers 173, 175 through a pair of intercommunication holes 188, 189 which are formed in the vicinity of the intermediate plate 171. In FIGS. 16 and 17, reference numeral 190 represents a lead valve type check valve 190 provided in the intercommunication hole 188 of the upper cylinder 169, and allows the fluid to flow from the valve hole 183 to the upper cylinder chamber 173 in only one direction. A refrigerant introducing hole 191 penetrates through both the cylinders 169 and 170 and the intermediate plate 171 in parallel to the valve hole 183, and gas refrigerant from the refrigerant pipe 146 is introduced into the refrigerant introducing hole 191. Further, intercommunication recess portions 193 and 194 for allowing the valve hole 183 and the refrigerant introducing hole 191 to intercommunicate with each other are formed in the main frame 165 and the bearing plate 167.

The electromagnetic valve 127 described above is interposed between first and second bypass pipes 145 and 146 for allowing the intercommunication between the discharge side refrigerant pipe 131 and the suck-in side refrigerant pipe 143 of the first compressor 105. The power save pipe 147 intercommunicating with the refrigerant introducing hole 191 is connected to the first bypass pipe 145, and the capillary tube 49 for reducing the flow amount of the gas refrigerant is disposed at the upstream side of the connection portion.

In this embodiment, when the power save mechanism 181 is actuated, the outdoor ECU 51 opens the electromagnetic valve 27 to allow the first bypass pipe 145 and the second bypass pipe 146 to intercommunicate with each other. At the time when the electromagnetic valve 27 is closed, the high-pressure refrigerant gas is introduced from the discharge-side refrigerant pipe 131 through the first bypass pipe 145 into the power save pipe 147. However, when the electromagnetic valve 27 is opened, this high-pressure refrigerant gas flows out through the second bypass pipe 146 into the suck-in side refrigerant pipe 143.

The supply amount of the high-pressure refrigerant gas from the first bypass pipe 145 is extremely small due to the action of the capillary tube 49, and thus the low-pressure refrigerant gas from the suck-in side refrigerant pipe 143 flows into the power save pipe 147. The capillary tube 49 also functions to reduce to an extremely small value the high-pressure refrigerant gas flowing from the discharge-side refrigerant pipe 131 to the suck-in side refrigerant pipe 143 when the discharge-side refrigerant pipe 131 is allowed to intercommunicate with the suck-in side refrigerant pipe 143 through the first and second bypass pipes 145, 146.

Accordingly, both the piston valves 185, 186 are pressed against the end faces of the main frame 165 and the bearing plate 167 respectively as shown in FIG. 16 by the spring force of the valve spring 187. As a result, both the cylinder chambers 173, 175 intercommunicate with each other through the intercommunication holes 188, 189, the valve hole 183 and the check valve 190, and the gas refrigerant flows from the compression space of the lower cylinder chamber 175 to the suck-in space of the upper cylinder chamber 173, whereby a half of the compression work of the lower cylinder chamber 175 of the compression mechanism 161 (i.e., 25%=1 horsepower as the entire compression mechanism 61) is saved.

On the other hand, when the actuation of the power save mechanism 181 is stopped, the outdoor ECU 51 closes the electromagnetic valve 27 to allow the first and second bypass pipes 145 and 146 to intercommunicate with each other. Accordingly, the high-pressure refrigerant gas from the discharge-side refrigerant pipe 131 is introduced into the power save pipe 147 through the first bypass pipe 145, and further the high-pressure refrigerant gas flows into the valve hole 183 through the refrigerant introducing hole 191 and the intercommunication recess portions 193, 194 as shown in FIG. 17.

Therefore, the high pressure (in this case, 75% of the maximum discharge pressure of the first compressor 105) acts on the pressure receiving faces of the piston valves 185 and 186, and the valve spring 187 is compressed, whereby both the piston valves 185 and 186 are approached to each other and then abut against the intermediate plate 171. As a result, the intercommunication holes 188, 189 are closed by the outer peripheral surfaces of the piston valves 185, 186, and the intercommunication between the cylinders 173, 175 is intercepted, whereby the overall compression work is performed in the compression mechanism 161, and the first compressor 105 generates the rating output (4 horsepower in this embodiment).

Figure 5:
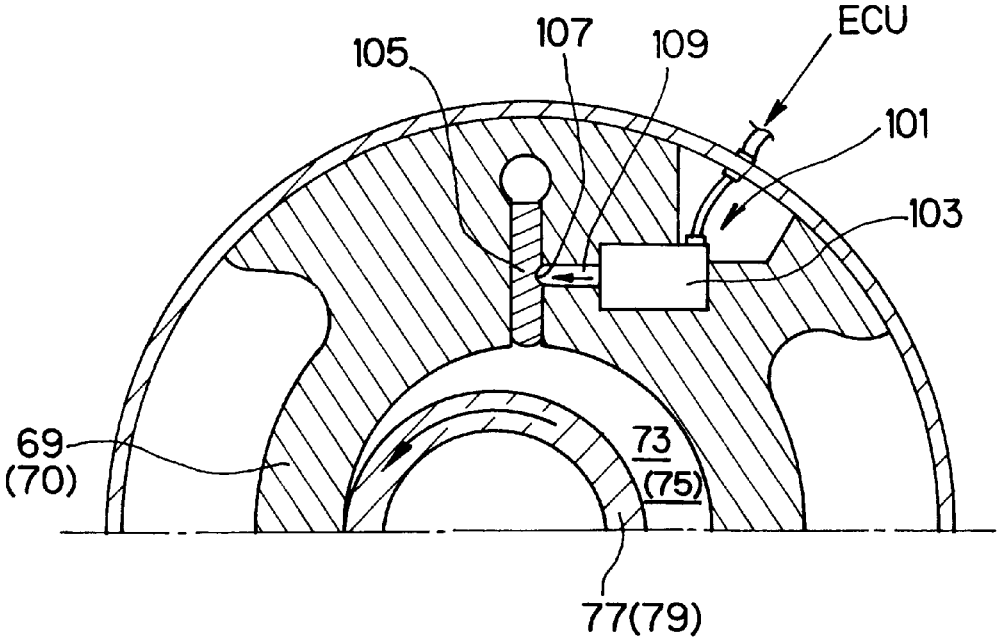
FIG. 5 is a partial cross-sectional view showing a state where the compression stop mechanism shown in FIG. 4 is actuated.
Figure 6:
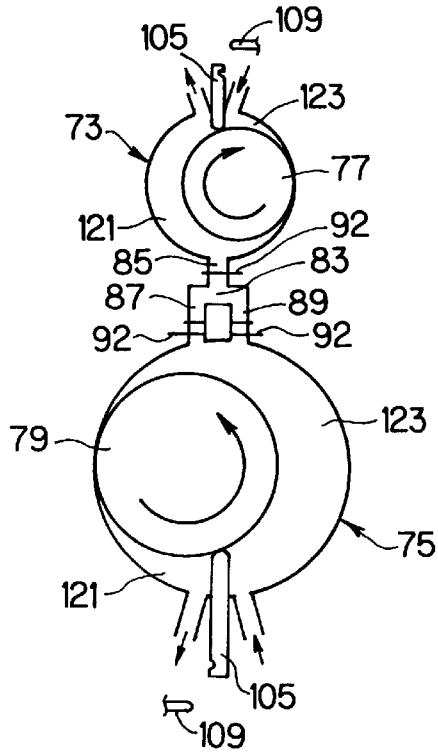
FIG. 6 is a schematic diagram showing the action of the compressor.

The construction and the operation of the compression stop mechanism of this embodiment is the same as the first embodiment shown in FIGS. 4 and 5 except that the compression stop mechanism 101 is installed into only the upper cylinder 169 of the first compressor 205, and the duplicative description thereof is omitted. Accordingly, the compression stop mechanism 101 of this embodiment comprises an electromagnetic stopper 103 embedded in the upper cylinder 169, and an engaging recess portion 107 which is formed in the vane 105.

By the actuation of the compression stop mechanism 101, no refrigerant suck-in and compression work is performed in the upper cylinder chamber as described above, and a part of the entire compression work of the compression mechanism 161 (in this embodiment, 50%=2 horsepower) is saved. When the electromagnetic stopper 103 is actuated, the lock pin 109 is instantaneously projected to the left, and the timing at which the tip of the lock pin is engagedly inserted into the engaging recess portion 107 corresponds to the instantaneous time at which the vane 105 is pushed into the upper cylinder 69 by the rotor 77 as in the case of the first embodiment.

Next, the flow of the refrigerant in cooling operation will be described.

The gas refrigerant which is sucked from the accumulator 15 through the refrigerant pipes 143, 144 into the first and second compressors 205, 207 is adiabatically compressed into high-temperature and high-pressure gas refrigerant, and discharged from the compressors 205, 207. The high-pressure gas refrigerant thus discharged is passed through the refrigerant pipes 132, 133, the oil separator 17 and the refrigerant pipe 32 and its path is controlled by the four-way change-over valve 9, finally flowing through the refrigerant pipe 33 into the outdoor heat exchanger 11. The high-temperature and high pressure gas refrigerant is cooled by the outside air while passing through the outdoor heat exchanger 11, and then condensed into liquid refrigerant. Thereafter, the liquid refrigerant flows into the electrically-driven expansion valve 21 of each indoor unit 3 through the refrigerant pipes 34 to 36.

The flow amount of the liquid refrigerant is controlled in the electrically-driven expansion valve 21, and then flows into the indoor heat exchanger 23 to be vaporized into gas refrigerant while passing through the indoor heat exchanger 23. The indoor air which is blown by the electrically-driven fan 25 is cooled by the vaporization latent heat in the vaporization process. At this time, the indoor ECU 52 controls the rotational number of the electrically-driven fan 7 on the basis of the difference between the set temperature and the room temperature, and controls the valve opening degree of the electrically-driven expansion valve 21 (the step number of a step motor for driving a needle) so that the difference between the inlet refrigerant temperature and the outlet refrigerant temperature of the indoor heat exchanger 23 is equal to a predetermined value (for example, 0 to 1° C.).

The gas refrigerant which is vaporized in the indoor heat exchanger 23 is passed through the refrigerant pipes 37 to 39, the four-way change-over valve 9 and the refrigerant pipe 40 and flows into the accumulator 15, and then sucked from the refrigerant pipes 143, 144 to the first and second compressors 205 and 207 again.

On the other hand, in heating operation, the four-way change-over valve 9 is switched as indicated by a broken line, and the flow of the refrigerant is opposite to that in cooling operation as indicated by an arrow of the broken line. That is, the high-temperature and high-pressure gas refrigerant which is discharged from the first and second compressors 205 and 207 is introduced into the indoor heat exchanger 23, and then condensed into liquid refrigerant while passing through the indoor heat exchanger 23. At this time, the indoor air which is blown by the electrically-driven fan 25 is heated by the condensation latent heat. Subsequently, the liquid refrigerant flows into the outdoor heat exchanger 11, is heated by the outside air to be vaporized into gas refrigerant while passing through the outdoor heat exchanger 11, and then sucked from the accumulator 15 into the first and second compressors 205 and 207 again.

When the driving of the air conditioner is started, the outdoor ECU 51 determines a target compression work on the basis of the input signals from the respective indoor ECUs 52 to perform not only the driving control of the first and second compressors 205, 207, but also the power save control and the compression stop control.

Figure 18:
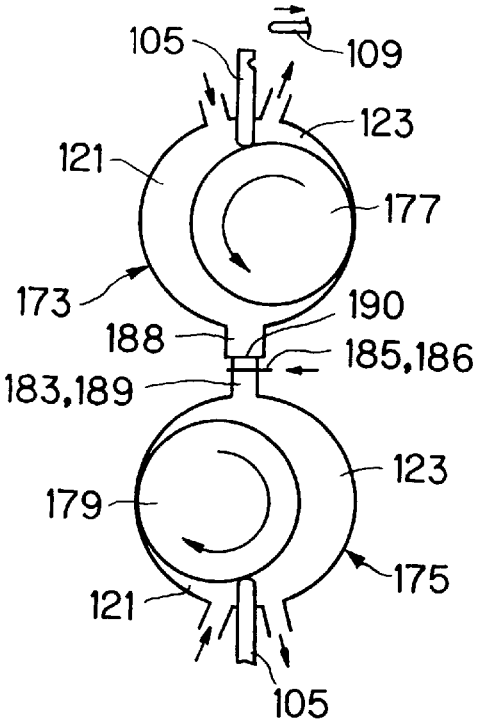
FIG. 18 is a schematic diagram showing the action of the compressor.
Figure 22:
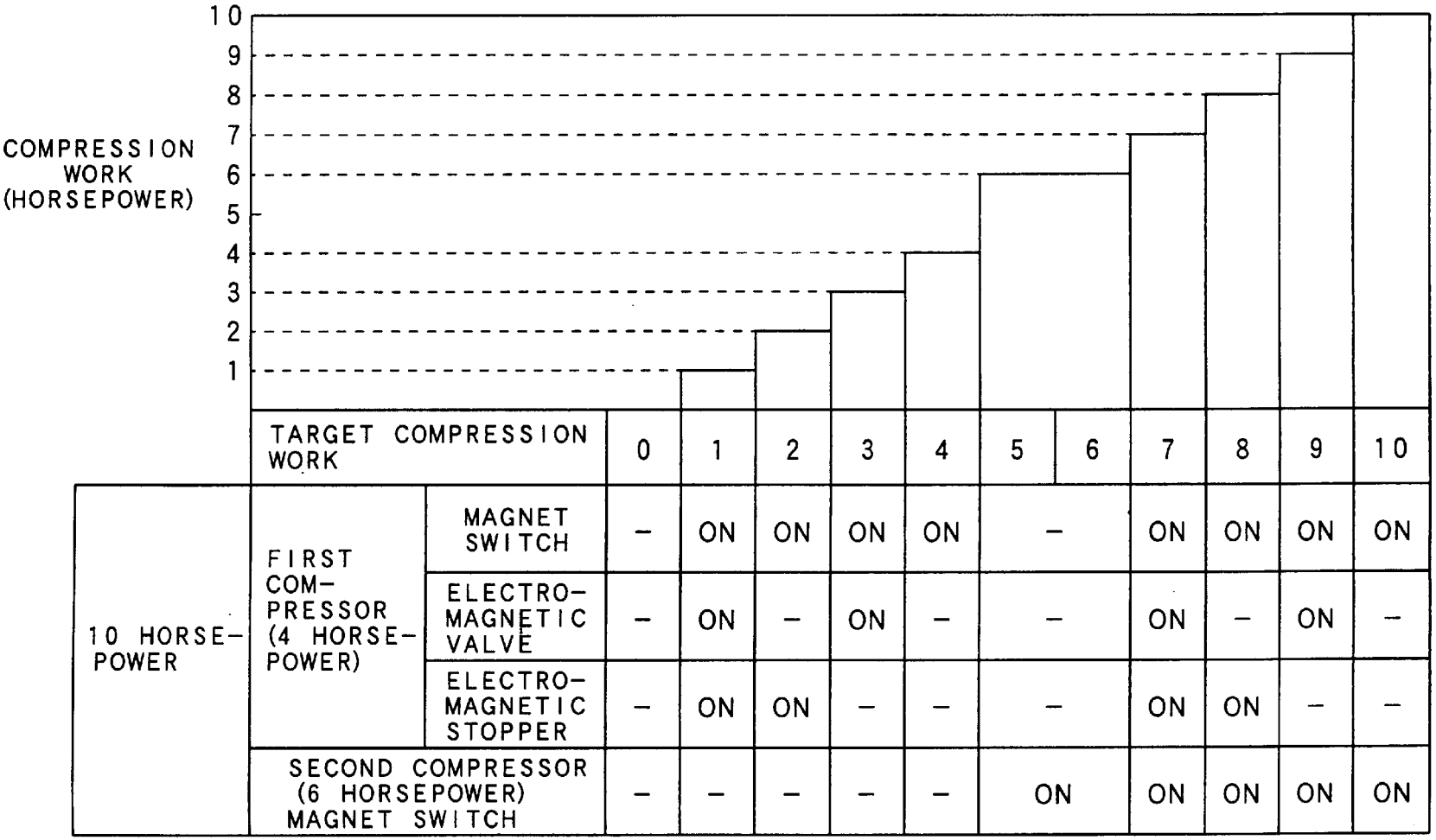
FIG. 22 is a diagram showing the relationship between the target compression work and the operation of each equipment.

That is, as shown in FIG. 22, when the target compression work is set to 10 horsepower, the outdoor ECU 51 actuates both the first and second compressors 205 and 207 (turning on the actuating magnet switch), and turns off the electromagnetic valve 27 and the electromagnetic stopper 103. In this case, since neither the power save mechanism 181 nor the compressor stop mechanism 201 are actuated, a predetermined compression work is performed in the cylinder chambers 173,175 of the first compressor 205 as shown in FIG. 18 and the rating outputs of the first and second compressors 205, 207 are equal to 4 horsepower and 6 horsepower respectively, a compression work of 10 horsepower is performed as the entire outdoor unit 1.

Figure 19:
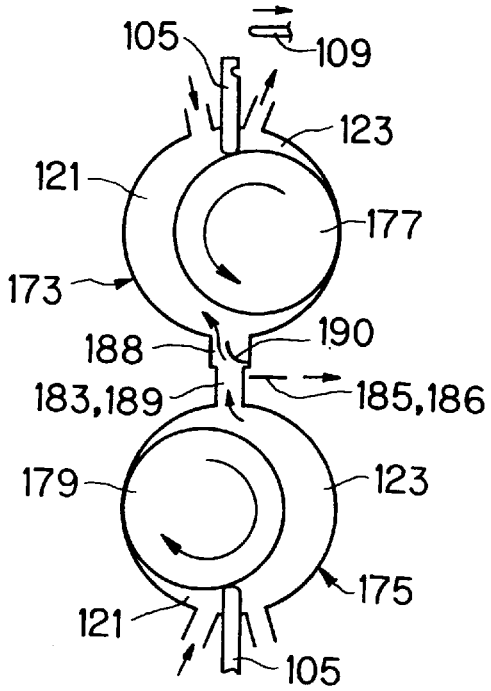
FIG. 19 is a schematic diagram showing the action of the compressor.

When the target compression work is set to 9 horsepower, the outdoor ECU 51 actuates both the first and second compressors 205 and 207, and turns on the electromagnetic valve 27. Accordingly, the power save mechanism 181 is actuated, and the gas refrigerant flows out from the compression space of the lower cylinder chamber 175 to the suck-in space 121 of the upper cylinder chamber 173 as shown in FIG. 19, whereby the compression work of 1 horsepower is saved in the first compressor 205 as described above. As a result, 1 horsepower is reduced from 10 horsepower and a compression work of 9 horsepower is performed as the entire outdoor unit 1.

Figure 20:
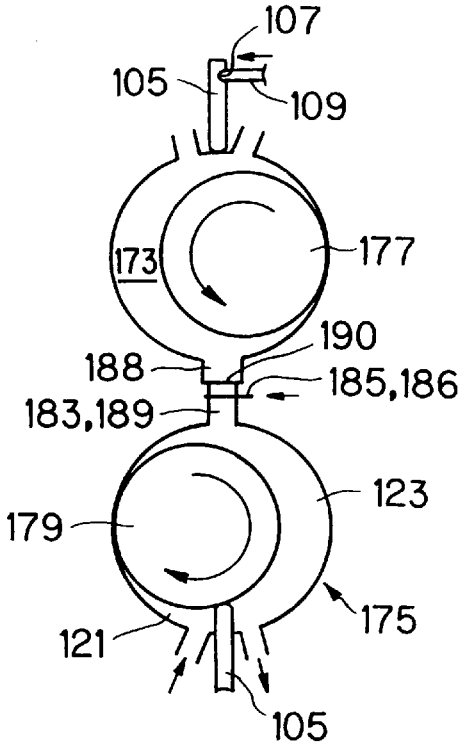
FIG. 20 is a schematic diagram showing the action of the compressor.
Figure 21:
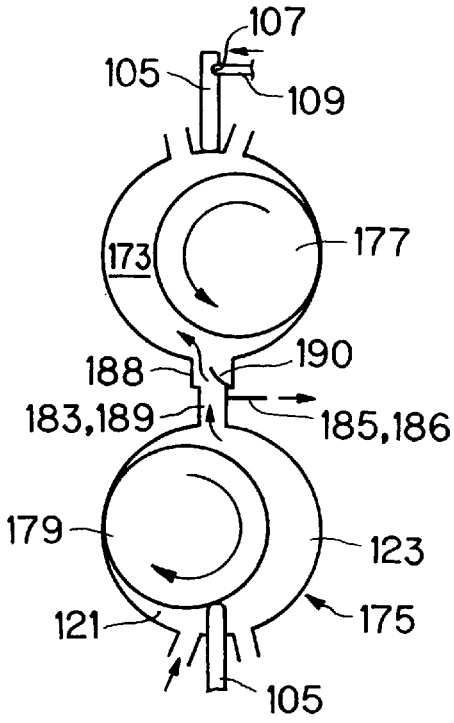
FIG. 21 is a schematic diagram showing the action of the compressor.

When the target compression work is set to 8 horsepower, the ECU 51 actuates the first and second compressors 205 and 207 and turns on the electromagnetic stopper 103. Accordingly, the compressor stop mechanism 101 is actuated, and as shown in FIG. 20, no compression work is performed in the upper cylinder chamber 173 and thus a compression work of 2 horsepower is saved in the first compressor 205 as described above. As a result, 2 horsepower is reduced from 10 horsepower and a compression work of 8 horsepower is performed as the entire outdoor unit 1.

When the target compression work is set to 7 horsepower, the outdoor ECU 51 actuates the first and second compressors 205 and 207, and turns on the electromagnetic valve 27 and the electromagnetic stopper 103. Accordingly, both the power save mechanism 181 and the compression stop mechanism 101 are actuated, and as shown in FIG. 20, the gas refrigerant flows out from the compression space 123 of the lower cylinder chamber 175 to the upper cylinder chamber 173 while no compression work is performed in the upper cylinder chamber 173, so that a compression work of totally 3 horsepower is saved in the first compressor 205. As a result, 3 horsepower is reduced from 10 horsepower and a compression work of 7 horsepower is performed as the entire outdoor unit 1.

When the target compression work is set to 5 horsepower or 6 horsepower, the outdoor ECU 51 actuates only the second compressor 207, so that a compression work of 6 horsepower is performed as the entire outdoor unit 1. In this embodiment, since the first compressor 205 has the rating output of 4 horsepower and the second compressor has the rating output of 6 horsepower, a compression work of 5 horsepower is not performed even when the power save mechanism 181 and the compression stop mechanism 101 which are provided to the first compressor 205 are used.

When the target compression work is set to 4 horsepower, the outdoor ECU 51 actuates only the first compressor 205, and turns off the electromagnetic valve 27 and the electromagnetic stopper 103. Accordingly, neither the power save mechanism 181 nor the compression stop mechanism 101 are actuated, and thus a predetermined compression work is performed in each of both the cylinder chambers 173 and 175 of the first compressor 205, whereby a compression work of 4 horsepower is performed as the entire outdoor unit 1.

When the target compression work is set to 3 horsepower, the outdoor ECU 51 actuates only the first compressor 205, and turns on the electromagnetic valve 27. Accordingly, the power save mechanism 181 is actuated, and a compression work of 1 horsepower is saved in the first compressor 205 as described above. As a result, 1 horsepower is reduced from 4 horsepower and a compression work of 3 horsepower is performed as the entire outdoor unit 1.

When the target compression work is set to 2 horsepower, the outdoor ECU 51 actuates only the first compressor 205, and turns on the electromagnetic stopper 103. Accordingly, the compression stop mechanism 101 is actuated, and a compression work of 2 horsepower is saved in the first compressor 205 as described above. As a result, 2 horsepower is reduced from 4 horsepower and a compression work of 2 horsepower is performed as the entire outdoor unit 1.

When the target compression work is set to 1 horsepower, the outdoor ECU 51 actuates only the first compressor 205, and turns on the electromagnetic valve 27 and the electromagnetic stopper 103. Accordingly, both the power save mechanism 181 and the compressor stop mechanism 101 are actuated, and a compression work of 3 horsepower is saved in the first compressor 205 as described above. As a result, 3 horsepower is reduced from 4 horsepower and a compression work of 1 horsepower is performed as the entire outdoor unit 1.

As described above, according to this embodiment, except for the case where the target compression work is equal to 5 horsepower, the power (capacity) control from 1 to 10 horsepower can be performed every 1 horsepower by combining the driving control of the first and second compressors 205 and 207 with the driving control of the power save mechanism 181 and the compression stop mechanism 101. This power control can be performed without any refrigerant return control which wastes the compression work.

The present invention is not limited to the above embodiment, and various modifications may be made to the embodiment without departing from the subject matter of the present invention as in the case of the first embodiment. For example, in the above embodiment, the power save mechanism and the compression stop mechanism are provided to one of the two constant-speed compressors. However, a single constant-compressor may be used, or three or more compressors may be used. Further, in the above embodiment, the power save mechanism and the compression stop mechanism are provided to a twin rotor type constant-speed compressor. However, a constant-speed compressor having a triple or more rotor type compressor. With respect to the power save mechanism, various structures may be considered. For example, an intercommunication circuit and an electromagnetic valve may be provided to the outside of the compressor casing. The save amount may be freely set. Further, high-pressure refrigerant gas may be used as a driving source for the compression stop mechanism. Still further, the construction of the refrigerant circuit may be suitably modified without departing the subject matter of the present invention.

As described above, according to the present invention, the power control of the constant-speed compressor is performed by the power save mechanism and the compression stop mechanism, and thus the multistage power control can be performed without any refrigerant return control which wastes the compression work, so that the energy efficiency can be enhanced.

What is claimed is:

1. A multi-rotor type compressor including:

plural compression elements each of which includes a rotor eccentrically rotating in a cylinder and a vane which is in sliding contact with the outer peripheral surface of said rotor and partitions the inside space of the cylinder into a suck-in space in which a suck-in operation is performed and a compression space in which a compressing operation is performed; and power save means including an intercommunication path through which the compression space of one of said compression elements is allowed to intercommunicate with the suck-in space of another one of said compression elements at a predetermined phase, an interception valve for intercepting flow of fluid in said intercommunication path, and a check valve which is provided in said intercommunication path and allows the fluid to flow therethrough in only one direction.

2. The compressor as claimed in claim 1, further including compression stop means which is provided at least one of said compression elements and allowing the intercommunication between the suck-in space and the compression space of said another compression element.

3. The compressor as claimed in claim 1, wherein said interception valve of said power save means comprises a spring member which expands and contracts in accordance with the pressure of the fluid flowing into said intercommunication path, and a piston member which is moved in a predetermined direction in accordance with the expansion and contraction of said spring member to thereby open or close said intercommunication path.

4. The compressor as claimed in claim 2, wherein said compression stop means comprises an electromagnetic stopper embedded in said cylinder, an engaging recess portion formed in said vane, and a lock pin which is engagedly inserted into said engaging recess portion by action of said electromagnetic stopper.

5. The compressor as claimed in claim 1, wherein said plural compression elements are different in excluded volume.

6. The compressor as claimed in claim 5, wherein the rotors of at least two compression elements are designed to be equal in diameter, but different in height, whereby said at least two compression elements are different in excluded volume.

7. An air conditioner having a multi-rotor type compressor, characterized in that said compressor comprising:

plural compression elements each of which includes a rotor eccentrically rotating in a cylinder and a vane which is in sliding contact with the outer peripheral surface of said rotor and partitions the inside space of the cylinder into a suck-in space in which a suck-in operation is performed and a compression space in which a compressing operation is performed; and power save means including an intercommunication path through which the compression space of one of said compression elements is allowed to intercommunicate with the suck-in space of another one of said compression elements at a predetermined phase, an interception valve for intercepting flow of fluid in said intercommunication path, and a check valve which is provided in said intercommunication path and allows the fluid to flow therethrough in only one direction.

8. The compressor as claimed in claim 7, further including compression stop means which is provided at least one of said compression elements and allowing the intercommunication between the suck-in space and the compression space of said another compression element.

9. The compressor as claimed in claim 7, wherein said interception valve of said power save means comprises a spring member which expands and contracts in accordance with the pressure of the fluid flowing into said intercommunication path, and a piston member which is moved in a predetermined direction in accordance with the expansion and contraction of said spring member to thereby open or close said intercommunication path.

10. The compressor as claimed in claim 8, wherein said compression stop means comprises an electromagnetic stopper embedded in said cylinder, an engaging recess portion formed in said vane, and a lock pin which is engagedly inserted into said engaging recess portion by action of said electromagnetic stopper.

11. The compressor as claimed in claim 7, wherein said plural compression elements are different in excluded volume.

12. The compressor as claimed in claim 11, wherein the rotors of at least two compression elements are designed to be equal in diameter, but different in height, whereby said at least two compression elements are different in excluded volume.

* * * * *